US005836246A

United States Patent [19]

Saito et al.

[11] Patent Number: 5,836,246

[45] Date of Patent: Nov. 17, 1998

[54] PRINTING PRESS

[75] Inventors: Nobuaki Saito; Hiroyuki Sugiyama, both of Ibaragi, Japan

[73] Assignee: Komori Corporation, Tokyo, Japan

[21] Appl. No.: 909,607

[22] Filed: Aug. 12, 1997

[30] Foreign Application Priority Data

Aug. 13, 1996 [JP] Japan ..... 8-213551

[51] Int. Cl.[6] ..... B41F 5/00

[52] U.S. Cl. ..... 101/216

[58] Field of Search ..... 101/216

[56] References Cited

U.S. PATENT DOCUMENTS 5,080,012 1/1992 Fischer et al. ..... 101/216

5,355,742 10/1994 Herrmann ..... 101/183

FOREIGN PATENT DOCUMENTS 3-24357 5/1991 Japan .

1455441 11/1976 United Kingdom ..... 101/216

*Primary Examiner*—Edgar Burr

*Assistant Examiner*—Amanda B. Sandusky

*Attorney, Agent, or Firm*—Blakely Sokoloff Taylor & Zafman

[57] ABSTRACT

A printing press includes a plurality of cylinders, a main drive system, an auxiliary drive system, and a torsion bar. The plurality of cylinders are arranged in parallel to each other in an axial direction and includes a plate cylinder. The main drive system is constituted by a plurality of drive gears that drive the plurality of cylinders by transmitting rotation of a drive unit thereto. The auxiliary drive system is connected to the main drive system and includes at least one drive gear that drives the plate cylinder by transmitting rotation of the main drive system thereto. The torsion bar applies a braking force to the plate cylinder through the auxiliary drive system in a direction opposite to that of rotation of the main drive system.

4 Claims, 5 Drawing Sheets

PRINTING PRESS

BACKGROUND OF THE INVENTION

The present invention relates to a printing press having a plurality of cylinders that are driven to rotate by a gear transmission unit and are in contact with each other.

In general, a gear transmission unit requires a backlash in order to allow smooth movement of two gears. In a precision machine and the like, if a backlash larger than necessary is allowed or occurs, it often leads to an adverse influence. For example, in a printing press, when two gears respectively formed on a blanket cylinder and an impression cylinder to mesh with each other wear to cause a backlash larger than necessary, striped streaks with an interval equal to the pitch of the gear, i.e., so-called gear streaks, occur on the printed surface, causing defective printing.

Paper used for printing ranges from thin paper to thick paper having different paper thicknesses. When the paper used for printing is changed from thin paper to thick paper, the printing pressure is not changed but the center-to-center distance between the blanket cylinder and impression cylinder is changed. In this case, the meshing amount of the gears formed on the blanket cylinder and impression cylinder changes, and a backlash larger than necessary occurs accordingly. In order to prevent occurrence of such a backlash larger than necessary, conventionally, the two gears are fabricated with high precision to decrease the backlash to the necessary minimum amount while they are fixed such that their center-to-center distance need not be adjusted, or gears having no backlash are used.

With the conventional method described above, since a manufacturing error occurs in the gears, it is difficult to always realize a necessary minimum backlash. Even if a necessary minimum backlash is realized, a backlash larger than necessary still occurs due to the wear of the gear surfaces of the gears. Even when gears having no backlash are used, a backlash larger than necessary does occur due to the wear of the gear surfaces of the gears. This causes defective printing and degrades the printing quality.

SUMMARY OF THE INVENTION

It is an object of the present invention to provide a printing press in which occurrence of a phase error between cylinders which is caused by the backlash of the gears is prevented to improve the printing quality.

In order to achieve the above object, according to the present invention, there is provided a printing press comprising a plurality of cylinders arranged in parallel to each other in an axial direction and including a first cylinder, a main drive system constituted by a plurality of drive gears that drive the plurality of cylinders by transmitting rotation of a drive unit thereto, an auxiliary drive system connected to the main drive system and having at least one drive gear that drives the first cylinder by transmitting rotation of the main drive system thereto, and braking force applying means for applying a braking force to the first cylinder through the auxiliary drive system in a direction opposite to that of rotation of the main drive system.

DESCRIPTION OF THE PREFERRED EMBODIMENTS

The present invention will be described in detail with reference to the accompanying drawings.

Figure 1:
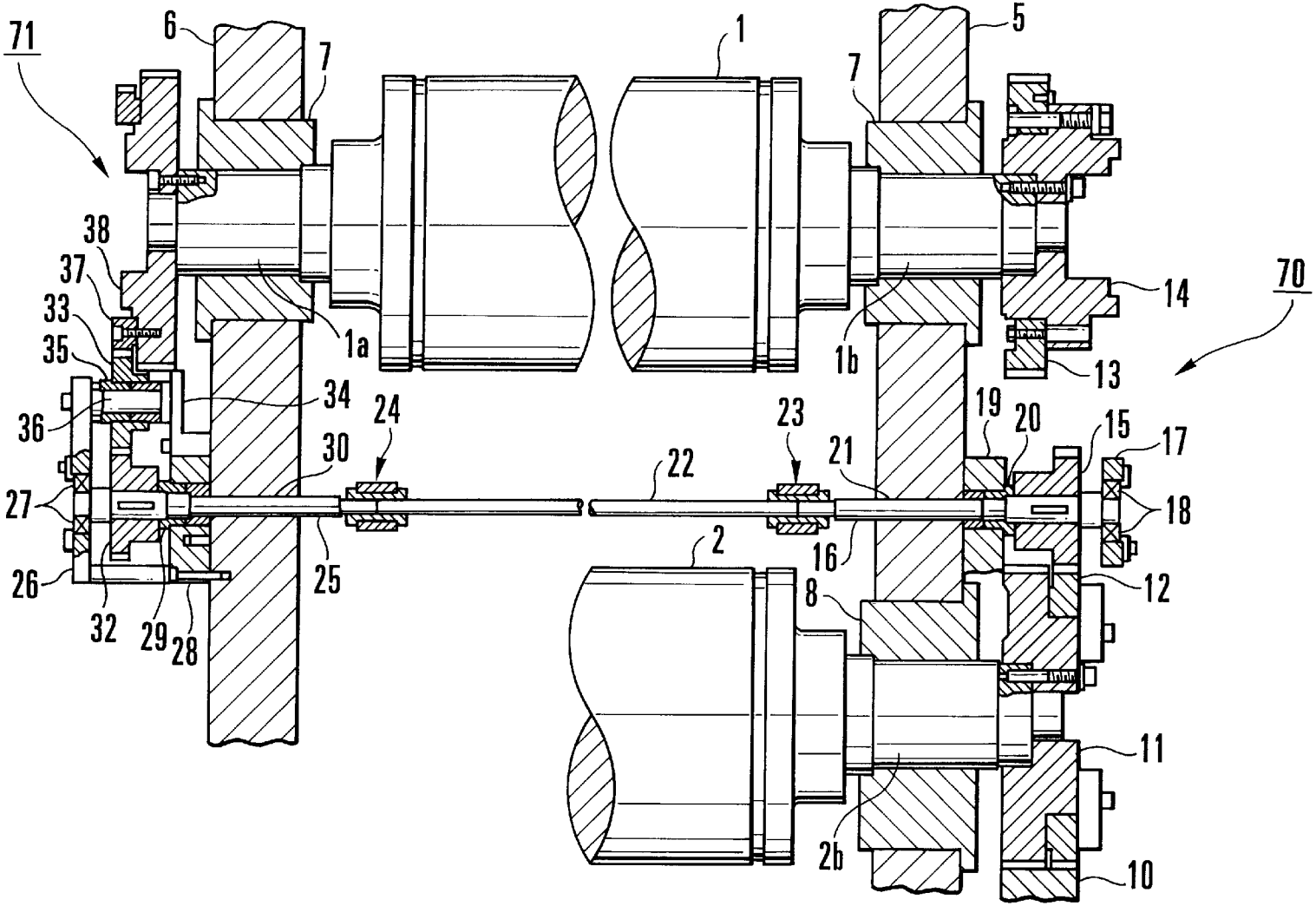
FIG. 1 is a developed side view showing the arrangement of the cylinders of a printing press according to the first embodiment of the present invention.
Figure 2:
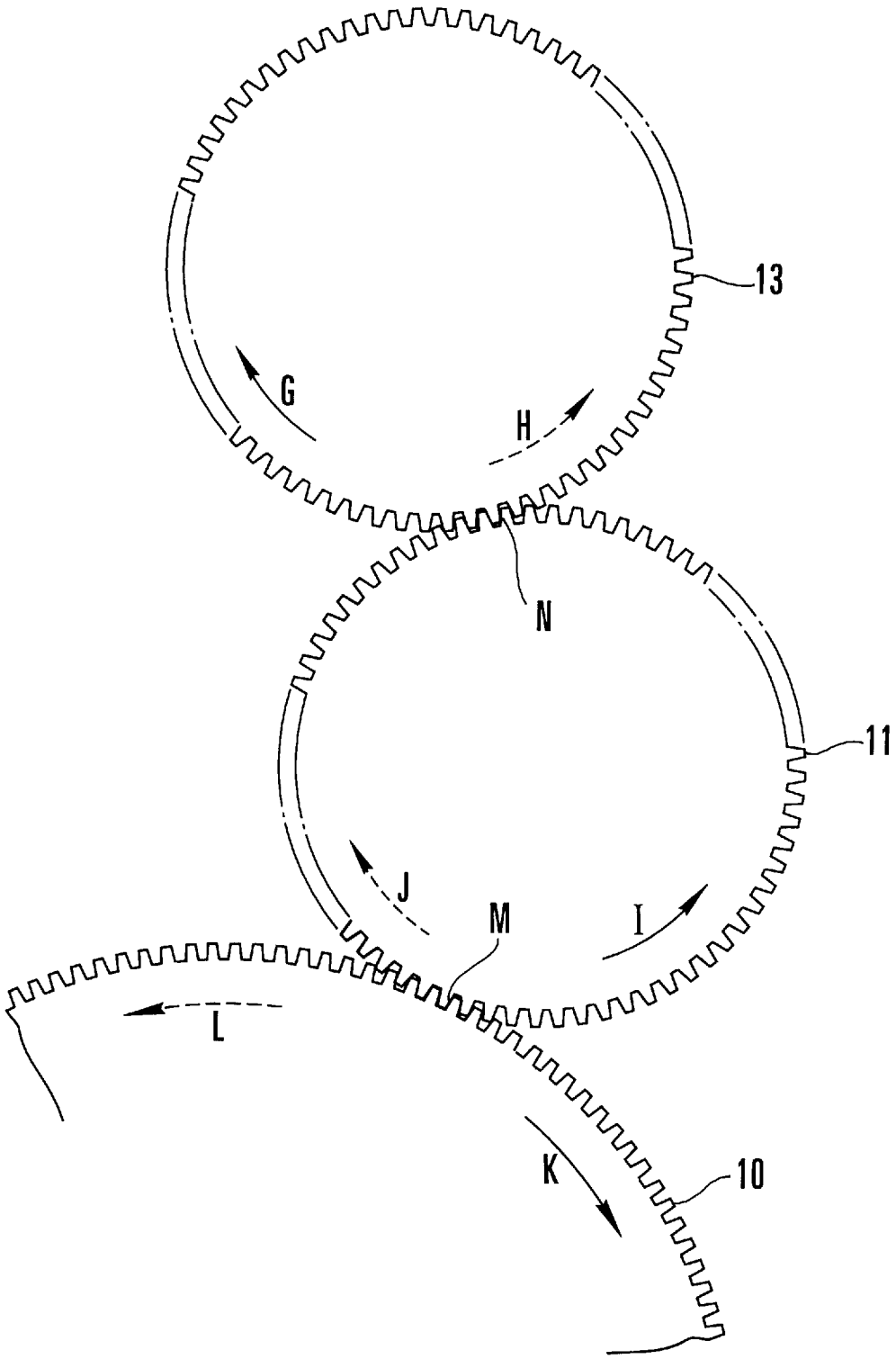
FIG. 2 is a front view of the gears of a main drive system shown in FIG. 1.

FIG. 1 shows the arrangement of the cylinders of a printing press according to the first embodiment of the present invention. Referring to FIG. 1, reference numeral 1 denotes a plate cylinder having a printing plate mounted on its circumferential surface. Two end shafts 1*a* and 1*b* of the plate cylinder 1 are rotatably supported by bearings 7 fitted in a pair of opposing frames 5 and 6. A blanket cylinder 2 having a blanket mounted on its circumferential surface is pressed against the plate cylinder 1 during printing. An end shaft 2*b* of the blanket cylinder 2 is rotatably supported by a bearing 8 fitted in the frame 5. The other end shaft (not shown) of the blanket cylinder 2 is rotatably supported by a bearing (not shown) fitted in the frame 6.

An impression cylinder gear 10 is axially mounted on one end shaft of an impression cylinder (not shown), and is driven to rotate by a motor (not shown). A blanket cylinder gear 11 is axially mounted on the end shaft 2*b* of the blanket cylinder 2, and meshes with the impression cylinder gear 10. A blanket cylinder sub-gear 12 is rotatably supported by the boss portion of the blanket cylinder gear 11, and meshes with the impression cylinder gear 10. A plate cylinder gear 13 is axially mounted on the end shaft 1*b* of the plate cylinder 1 through a fixing member 14, and meshes with the blanket cylinder gear 11. In FIG. 1, the blanket cylinder gear 11 and the plate cylinder gear 13 are separate from each other for the sake of illustrative convenience.

The impression cylinder gear 10, the blanket cylinder gear 11, and the plate cylinder gear 13 constitute a main drive system 70 that sequentially transmits the rotation force of the motor to the blanket cylinder 2 and plate cylinder 1.

An intermediate gear 15 is fixed on a shaft 16 with a key, and meshes with the blanket cylinder sub-gear 12. The intermediate gear 15 rotates together with the shaft 16. One end portion and the central portion of the shaft 16 are respectively, rotatably supported by bearings 18 and 20 respectively fitted in a support plate 17 and a bracket 19 fixed to the frame 5. The other end of the shaft 16 extends through a hole 21 formed in the frame 5. A torsion bar 22 extends between the frames 5 and 6. One end of the torsion bar 22 is integrally connected through a coupling 23 to the other end of the shaft 16 which projects into the frame 5.

The other end of the torsion bar 22 is integrally connected through a coupling 24 to one end of a shaft 25 extending through a hole 30 formed in the frame 6. One end portion and the central portion of the shaft 25 are rotatably supported by bearings 27 and 29 respectively fitted in a support plate 26 and a bracket 28 fixed on the frame 6. An intermediate gear 32 is fixed on the shaft 25 with a key and rotates together with the shaft 25. A transmission gear 33 is rotatably supported, through a bearing 35, by a shaft 36 extending horizontally between the support plate 26 and a bracket 34 fixed on the frame 6, and meshes with the intermediate gear 32. A channel gear 37 is fixed on a plate cylinder gear 38 fixed on the end shaft 1*a* of the plate cylinder 1 and meshes with the transmission gear 33. The channel gear 37 rotates together with the plate cylinder gear 38.

The intermediate gears 15 and 32, the shafts 16 and 25, the torsion bar 22, the transmission gear 33, and the plate cylinder gear 38 constitute an auxiliary drive system 71 that sequentially transmits the rotation force to the plate cylinder 1 in a manner to be described later.

Figure 4:
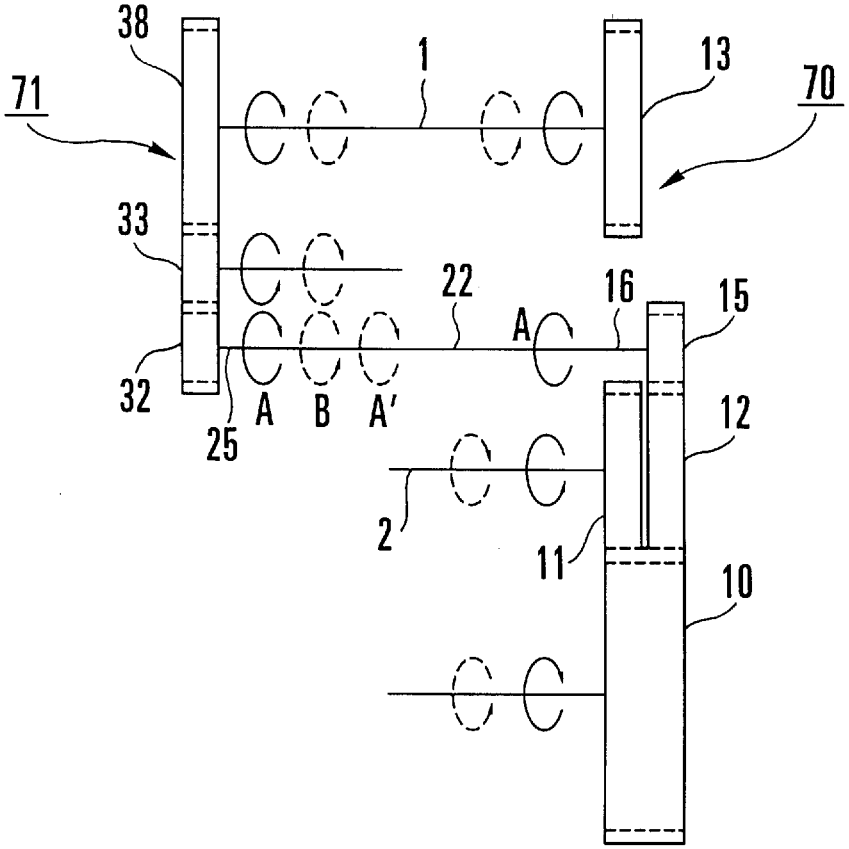
FIG. 4 is a view for explaining the transmitting and rotating direction and braking direction of the gears of the main and auxiliary drive systems shown in FIG. 1.

In this arrangement, when the impression cylinder gear 10 is driven to rotate by the motor, its rotation in the direction of an arrow indicated by a solid line in FIG. 4 is sequentially transmitted to the respective gears. More specifically, in the main drive system 70, rotation of the impression cylinder gear 10 is transmitted to the blanket cylinder gear 11 and then to the plate cylinder gear 13. Simultaneously, rotation of the impression cylinder gear 10 is also sequentially transmitted to the blanket cylinder sub-gear 12 and the intermediate gear 15. In the auxiliary drive system 71, rotation of the intermediate gear 15 is transmitted to the intermediate gear 32 through the shaft 16, the torsion bar 22, and the shaft 25. Rotation of the intermediate gear 32 is transmitted to the plate cylinder gear 38 through the transmission gear 33.

The number of teeth of the respective gears constituting the main and auxiliary drive systems 70 and 71 is set such that the plate cylinder gears 13 and 38 fixed on the two end shafts 1*b* and 1*a* of the plate cylinder 1 rotate in the same direction at the same rotation speed.

The two ends of the torsion bar 22 interposed between the intermediate gears 15 and 32 are connected to the shafts 16 and 25 through the couplings 23 and 24, respectively, such that torsion is applied to its other end portion side near the intermediate gear 32 in a rotating direction A' (indicated by an alternate long and short dashed line), i.e., in the same direction as a rotating direction A (indicated by a solid line) of the torsion bar 22 which is rotated upon transmission of the rotation from the intermediate gear 15.

Figure 3:
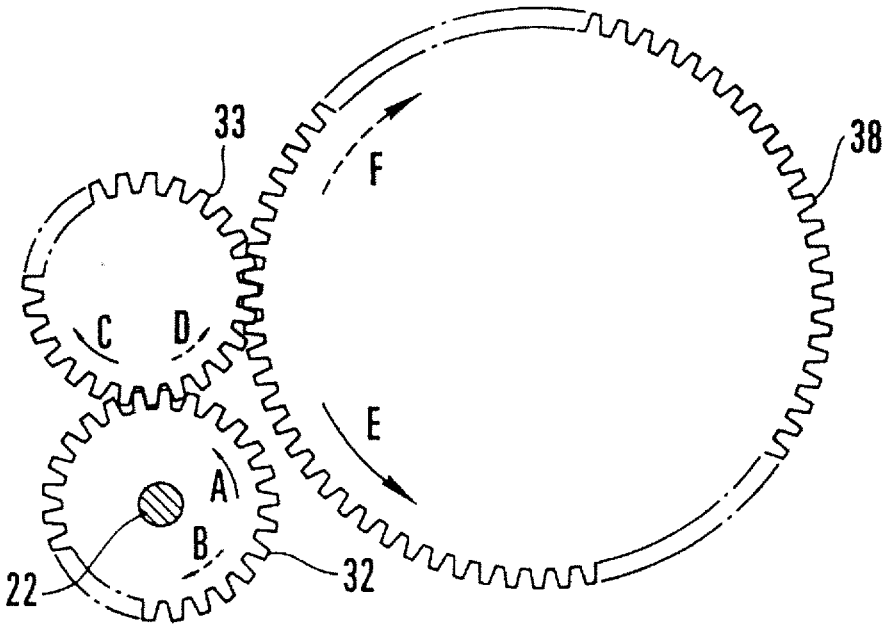
FIG. 3 is a front view of the gears of an auxiliary drive system shown in FIG. 1.

As shown in FIG. 3, a reaction force is applied to the intermediate gear 32 by the torsion bar 22 in a direction B (indicated by a broken line) opposite to its rotation transmitting direction A. Therefore, a braking force acts on the transmission gear 33 which meshes with the intermediate gear 32 to be driven to rotate in a rotation transmitting direction C, in a direction D opposite to its rotation transmitting direction C. Furthermore, a rotation force also acts on the plate cylinder gear 38 which meshes with the transmission gear 33 through the channel gear 37, in a direction F opposite to its rotation transmitting direction E.

This rotation force is transmitted through the plate cylinder 1 to the plate cylinder gear 13 of the main drive system 70 on the other side of the plate cylinder 1 to rotate it in a direction H opposite to its rotation transmitting direction G. Accordingly, a rotation force acts on the blanket cylinder gear 11 which meshes with the plate cylinder gear 13, in a direction J opposite to its rotation transmitting direction I. A rotation force also acts on the impression cylinder gear 10 which meshes with the blanket cylinder gear 11, in a direction L opposite to its rotation transmitting direction K.

In this manner, in the main drive system 70 to which the rotation force from the auxiliary drive system 71 acts in the opposite direction to the rotation transmitting direction, when rotation is to be transmitted from the impression cylinder gear 10 to the blanket cylinder gear 11 and from the blanket cylinder gear 11 to the plate cylinder gear 13, the gears 10 and 11, and the gears 11 and 13 mesh with each other at points M and N, respectively, always with their gear surfaces on the same side as the rotation transmitting direction such that the gear surfaces are pressed against each other.

As a result, when rotation is to be transmitted between the gears 10 and 11, and between the gears 11 and 13, play caused by the backlash allowed between the two gears 10 and 11, and 11 and 13 is suppressed, so that gear streaks caused by the backlash are prevented during printing. As a result, defective printing is prevented, and vibration and noise are reduced.

In order to suppress play caused by a backlash, the auxiliary drive system 71 is arranged on the opposite side of the main drive system 70 through the cylinder group including the plate cylinder 1 and the like. In a printing press having a structure disclosed in, e.g., Japanese Utility Model Publication No. 3-24357, a registration adjusting unit is provided which adjusts registration of a plate by circumferential adjustment by moving the plate cylinder gear in the axial direction, and an auxiliary drive system 71 cannot be provided on the same side as a main drive system 70 due to limitation on space. The present invention can be applied to such a printing press as well.

Figure 5:
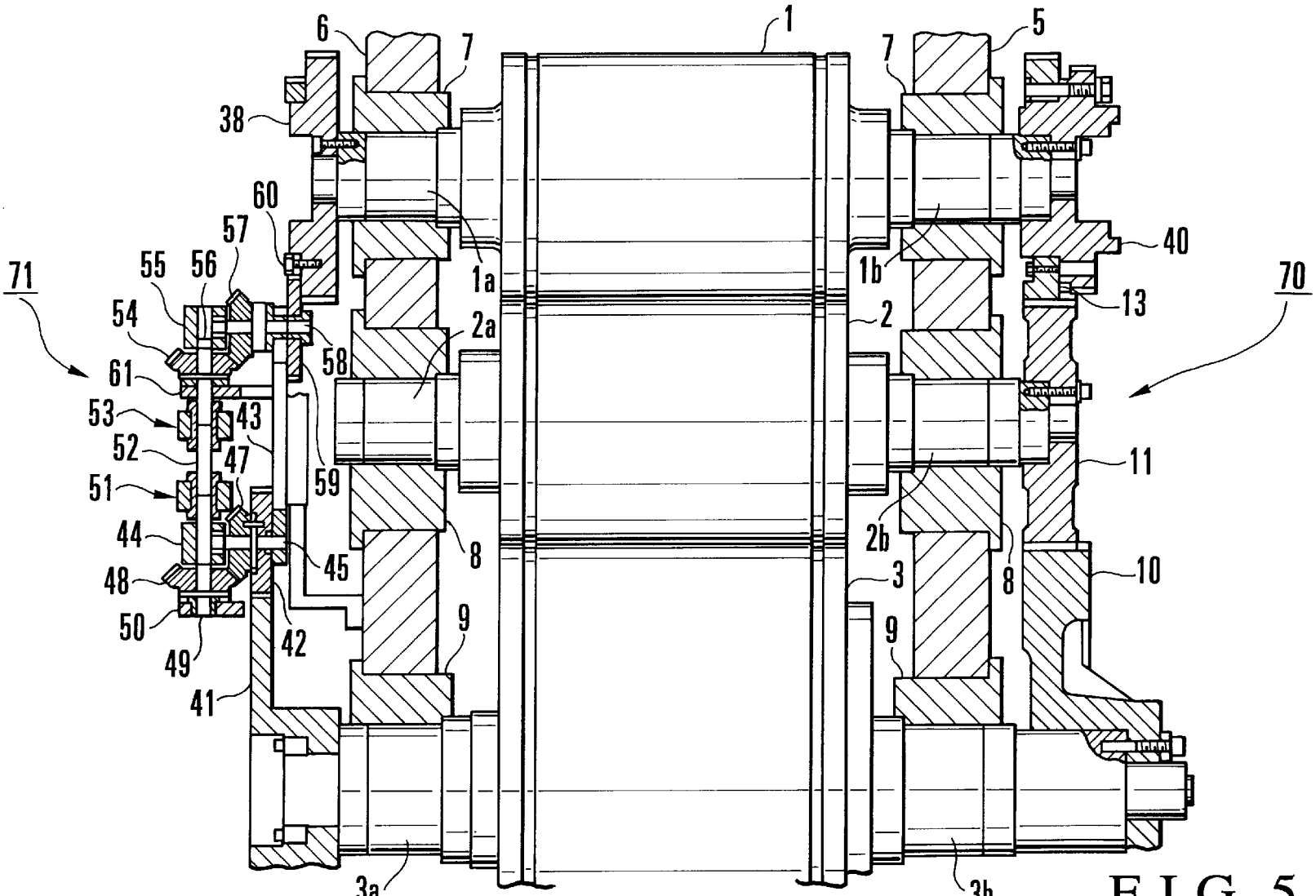
FIG. 5 is a developed side view showing the arrangement of the cylinders of a printing press according to the second embodiment of the present invention.

FIG. 5 shows the arrangement of the cylinders of a printing press according to the second embodiment of the present invention. Referring to FIG. 5, members identical or similar to those described in FIG. 1 are denoted by the same reference numerals, and a detailed description thereof will be omitted. Reference numeral 3 denotes an impression cylinder whose circumferential surface is pressed against a blanket cylinder 2 during printing. End shafts 3*a* and 3*b* of the impression cylinder 3 are rotatably supported through bearings 9 fixed in two frames 5 and 6. As separate impression cylinder gear 41 is fixed on the end portion of the end shaft 3*a* projecting from the frame 6.

An intermediate gear 42 meshes with the impression cylinder gear 41, and is fixed on a bevel gear 47 with a bolt. The bevel gear 47 is axially mounted on a shaft 45. The two ends of the shaft 45 are rotatably supported through bearings respectively fitted in a support plate 43 and in a support member 44 which are fixed on the frame 6 through brackets (not shown). A bevel gear 48 meshes with the bevel gear 47, and is axially mounted on one end side of a shaft 49 extending in parallel to the frame 6. One end portion and the central portion of the shaft 49 are rotatably supported through bearings respectively fitted in a support plate 50 and a support member 44 which are fixed on the frame 6 through brackets (not shown).

A torsion bar 52 extends in a direction perpendicular to the axis of the cylinder group including the plate cylinder 1 and the like. One end portion of the torsion bar 52 is integrally connected to the other end portion of the shaft 49 through a coupling 51. The other end of the torsion bar 52 is integrally connected to one end portion of a shaft 56 through a coupling 53. The other end portion and the central portion of the shaft 56 are rotatably supported through bearings respectively fitted in a support plate 61 and a support member 55 which is fixed on the frame 6 through a bracket (not shown).

A bevel gear 54 is axially mounted on the other end side of the shaft 56 and meshes with a bevel gear 57. The bevel gear 57 is axially mounted on a shaft 58 whose two ends are rotatably supported through bearings respectively fitted in the support plate 43 and support member 55. An intermediate gear 59 is axially mounted on the end portion of the shaft 58 which projects from the support plate 43. The intermediate gear 59 meshes with a channel gear 60 fixed on a plate cylinder gear 38.

The impression cylinder gear 41, the two intermediate gears 42 and 59, the bevel gears 47, 48, 54, and 57, the two shafts 49 and 56, the torsion bar 52, the channel gear 60, and the plate cylinder gear 38 constitute an auxiliary drive system 71.

In this arrangement, when the impression cylinder gear 10 is driven to rotate by a motor, rotation of the impression cylinder gear 10 is transmitted to a blanket cylinder gear 11 of a main drive system 70 and then to a plate cylinder gear 13, in the same manner as in the first embodiment.

Simultaneously, rotation of the impression cylinder gear 10 is also transmitted to the auxiliary drive system 71 through the impression cylinder 3. More specifically, rotation of the impression cylinder gear 10 is transmitted to the impression cylinder gear 41 that rotates integrally with the impression cylinder 3, is sequentially transmitted to the torsion bar 52 through the intermediate gear 42, the bevel gears 47 and 48, and the shaft 49, and is then transmitted to the plate cylinder gear 38 through the shaft 56, the bevel gears 54 and 57, the intermediate gear 59, and the channel gear 60.

The torsion bar 52 is connected to the two shafts 49 and 56 such that torsion is applied to its coupling 53 side in the rotation transmitting direction of the intermediate gear 42. With this arrangement, a reaction force of the torsion bar 52 acts on the respective gears on the downstream side of the torsion bar 52 in the rotation transmitting direction, in the direction opposite to their rotation transmitting directions, in order to apply a braking force to the plate cylinder 1 in the direction opposite to its rotation transmitting direction.

Because of the braking force of the plate cylinder 1, a rotation force acts on the plate cylinder gear 13 of the main drive system 70 in the direction opposite to its rotation transmitting direction, and a rotation force also acts on the blanket cylinder gear 11 meshing with the plate cylinder gear 13 in the direction opposite to its rotation transmitting direction, in the same manner as in the first embodiment. As a result, during transmission of the rotation between the two gears 10 and 11 and between the two gears 11 and 13, play caused by a backlash allowed between the two gears 10 and 11, and 11 and 13 is suppressed, so that defective printing is prevented, and vibration and noise are reduced.

In the above embodiments, the torsion bar 22 or 52 is used as a means for applying a braking force to the plate cylinder 1. However, the present invention is not limited to them but can use a torsion coil spring instead. Any member can be employed as far as it is an elastic member that applies torsion to the auxiliary drive system 71. A case wherein the plate cylinder 1 is driven is explained. However, the present invention can also be applied to a case wherein other cylinders are driven, depending on the arrangement of the cylinder group. The auxiliary drive system 71 is arranged on the opposite side of the main drive system 70 through the cylinder. However, the auxiliary drive system 71 may be arranged in tandem with the main drive system 70 on one side of the cylinder.

As has been described above, according to the present invention , a main drive system, an auxiliary drive system, and a braking force applying means are provided. The main drive system comprises a plurality of drive gears for transmitting a driving force from the drive unit to the cylinder. The auxiliary drive system branches from the main drive system to drive one of a plurality of cylinders. The braking force applying means applies to the auxiliary drive system a rotation force in the direction opposite to the rotational drive direction of the main drive system. Play caused by a backlash is suppressed in the main drive system during transmission of the rotation. As a result, defective printing can be prevented, and vibration and noise can be reduced.

The main drive system and the auxiliary drive system are arranged to sandwich the cylinder. Hence, the present invention can also be applied to a printing press in which the auxiliary drive system cannot be arranged on the same side as the main drive system due to the space limitation.

What is claimed is:

1. A printing press comprising:

a plurality of cylinders arranged in parallel to each other in an axial direction and including a first cylinder;

a main drive system constituted by a plurality of drive gears and a drive unit that drive said plurality of cylinders by transmitting rotation of said drive unit.

an auxiliary drive system connected to said main drive system and having at least one drive gear that drives said first cylinder by transmitting rotation of said main drive system thereto, said auxiliary drive system is arranged on a side opposite to said main drive system through said plurality of cylinders;

a rotation transmitting mechanism arranged in parallel to said plurality of cylinders to transmit rotation of said main drive system to said auxiliary drive system, said rotation transmitting mechanism comprises a second cylinder among said plurality of cylinders, and braking force applying means for applying a braking force to said first cylinder through said auxiliary drive system in a direction opposite to that of rotation of said main drive system, said braking force applying means comprises a torsion bar arranged on a rotation transmitting line of said auxiliary drive system in a direction perpendicular to said plurality of cylinders, to connect a rotation transmitting line of said main drive system and a rotation transmitting line of said first cylinder while applying torsion thereto in a rotating direction.

2. A printing press according to claim 1, wherein said drive gears of said main drive system are fixed to first ends of said plurality of cylinders, and said drive gear of said auxiliary drive system is fixed to a second end of said first cylinder.

3. A printing press according to claim 1, further comprising first and second shafts integrally connected to two ends of said torsion bar, a first bevel gear mechanism for transmitting rotation of said second cylinder to said first shaft while changing a rotation surface thereof, and a second bevel gear mechanism for transmitting rotation of said second shaft to said second cylinder while changing a rotation surface thereof.

4. A printing press according to claim 1, wherein said first cylinder is a plate cylinder which is driven to rotate by said main drive system, and said braking force applying means applies a braking force to said plate cylinder through said auxiliary drive system.

* * * * *